US010975489B2

(12) United States Patent
Fortner et al.

(10) Patent No.: US 10,975,489 B2
(45) Date of Patent: Apr. 13, 2021

(54) ONE-PIECE ANODE FOR TUNING ELECTROPLATING AT AN EDGE OF A SUBSTRATE

(71) Applicant: Lam Research Corporation, Fremont, CA (US)

(72) Inventors: James Isaac Fortner, Newberg, OR (US); Robert Rash, West Linn, OR (US)

(73) Assignee: Lam Research Corporation, Fremont, CA (US)

( * ) Notice: Subject to any disclaimer, the term of this patent is extended or adjusted under 35 U.S.C. 154(b) by 39 days.

(21) Appl. No.: 16/206,700

(22) Filed: Nov. 30, 2018

(65) Prior Publication Data

US 2020/0173052 A1 Jun. 4, 2020

(51) Int. Cl.

| | |
|---|---|
| ***C25C 7/00*** | (2006.01) |
| ***C25B 11/02*** | (2021.01) |
| ***C25D 17/00*** | (2006.01) |
| ***C25D 5/08*** | (2006.01) |
| ***C25D 17/12*** | (2006.01) |
| ***C25D 5/04*** | (2006.01) |

(52) U.S. Cl.

CPC ..... *C25D 17/001* (2013.01); *C25D 5/04* (2013.01); *C25D 5/08* (2013.01); *C25D 17/002* (2013.01); *C25D 17/007* (2013.01); *C25D 17/12* (2013.01)

(58) Field of Classification Search

CPC .... C25C 7/02; C25C 7/00; C25C 1/12; C25B 11/02; C25B 9/04; C25B 9/06; C25B 13/02

USPC ..... 204/288

See application file for complete search history.

(56) References Cited

U.S. PATENT DOCUMENTS

| | | | | |
|---|---|---|---|---|
| 3,809,641 | A * | 5/1974 | Miyata | C25D 17/26 204/213 |
| 4,721,601 | A | 1/1988 | Wrighton et al. | |
| 5,938,899 | A | 8/1999 | Forand | |
| 5,985,126 | A | 11/1999 | Bleck et al. | |

(Continued)

OTHER PUBLICATIONS

U.S. Office Action, dated Mar. 13, 2013, issued in U.S. Appl. No. 12/879,484 [NOVLP369].

(Continued)

*Primary Examiner* — Zulmariam Mendez
(74) *Attorney, Agent, or Firm* — Weaver Austin Villeneuve & Sampson LLP

(57) ABSTRACT

An active (consumable) anode includes, in one aspect, a generally annular body and a protrusion used for connecting the anode to the power supply, where the protrusion extends outward from the generally annular body of the anode. The compositions of the generally annular body and of the protrusion are the same, and, in some embodiments, the anode is a one-piece anode that does not include any welding seams. Such structure results in reduced voltage fluctuations during plating and in improved control over plating uniformity. In some embodiments, the anode is a copper anode, a cobalt anode, or a nickel anode machined from a single sheet of anode-grade metal. The provided anode can be used in an electroplating apparatus as a secondary, peripherally disposed anode, in conjunction with a more centrally located primary anode. The provided anode is configured to modulate electroplating at the edge of the substrate.

17 Claims, 9 Drawing Sheets

(56) References Cited

U.S. PATENT DOCUMENTS

| | | | | |
|---|---|---|---|---|
| 6,113,759 | A | 9/2000 | Uzoh | |
| 6,126,798 | A | 10/2000 | Reid et al. | |
| 6,156,167 | A | 12/2000 | Patton et al. | |
| 6,179,983 | B1 | 1/2001 | Reid et al. | |
| 6,228,232 | B1 | 5/2001 | Woodruff et al. | |
| 6,402,923 | B1 | 6/2002 | Mayer | |
| 6,569,299 | B1 | 5/2003 | Reid et al. | |
| 6,755,954 | B2 | 6/2004 | Mayer et al. | |
| 6,800,187 | B1 | 10/2004 | Reid et al. | |
| 6,890,416 | B1 | 5/2005 | Mayer et al. | |
| 6,964,792 | B1 | 11/2005 | Mayer et al. | |
| 7,014,739 | B2 | 3/2006 | Lin et al. | |
| 7,316,602 | B2 | 1/2008 | Basol et al. | |
| 7,622,024 | B1 | 11/2009 | Mayer et al. | |
| 8,262,871 | B1 | 9/2012 | Mayer et al. | |
| 9,028,657 | B2 | 5/2015 | Feng et al. | |
| 9,045,840 | B2 | 6/2015 | Porter et al. | |
| 9,340,893 | B2 | 5/2016 | Feng et al. | |
| 10,351,968 | B2 | 7/2019 | Feng et al. | |
| 2001/0020583 | A1 | 9/2001 | Woodruff et al. | |
| 2002/0020627 | A1* | 2/2002 | Kunisawa | H01L 21/6723 205/96 |
| 2003/0209443 | A1 | 11/2003 | Lubomirsky | |
| 2004/0084316 | A1 | 5/2004 | Muranaka | |
| 2005/0056538 | A1 | 3/2005 | Kovarsky et al. | |
| 2005/0092610 | A1 | 5/2005 | Moore | |
| 2006/0243598 | A1 | 11/2006 | Singh et al. | |
| 2007/0068819 | A1 | 3/2007 | Singh et al. | |
| 2007/0175752 | A1 | 8/2007 | Yang et al. | |
| 2009/0065363 | A1* | 3/2009 | Liakopoulos | C25D 3/562 205/89 |
| 2009/0211900 | A1 | 8/2009 | Rash et al. | |
| 2010/0032310 | A1 | 2/2010 | Reid et al. | |
| 2010/0044236 | A1 | 2/2010 | Mayer et al. | |
| 2010/0116672 | A1 | 5/2010 | Mayer et al. | |
| 2010/0147679 | A1 | 6/2010 | Feng et al. | |
| 2012/0061246 | A1* | 3/2012 | Feng | C25D 17/001 205/157 |
| 2013/0105307 | A1* | 5/2013 | Pavlovic | C25B 9/06 204/262 |
| 2013/0134045 | A1 | 5/2013 | Porter et al. | |
| 2015/0211144 | A1 | 7/2015 | Feng et al. | |
| 2016/0222541 | A1 | 8/2016 | Feng et al. | |

OTHER PUBLICATIONS

U.S. Final Office Action, dated Jul. 30, 2013, issued in U.S. Appl. No. 12/879,484 [NOVLP369].

U.S. Office Action, dated Apr. 10, 2014, issued in U.S. Appl. No. 12/879,484 [NOVLP369].

U.S. Office Action, dated Aug. 6, 2014, issued in U.S. Appl. No. 12/879,484 [NOVLP369].

U.S. Notice of Allowance, dated Jan. 8, 2015, issued in U.S. Appl. No. 12/879,484 [NOVLP369].

U.S. Office Action, dated Jan. 22, 2016, issued in U.S. Appl. No. 14/678,686 [NOVLP369C1].

U.S. Notice of Allowance, dated Apr. 6, 2016, issued in U.S. Appl. No. 14/678,686 [NOVLP369C1].

U.S. Office Action, dated Mar. 21, 2018, issued in U.S. Appl. No. 15/093,435 [NOVLP369C2].

U.S. Office Action, dated Sep. 20, 2018, issued in U.S. Appl. No. 15/093,435 [NOVLP369C2].

U.S. Notice of Allowance, dated Mar. 8, 2019, issued in U.S. Appl. No. 15/093,435 [NOVLP369C2].

U.S. Office Action, dated Sep. 22, 2014, issued in U.S. Appl. No. 13/306,527 [NOVLP440].

U.S. Notice of Allowance, dated Feb. 27, 2015, issued in U.S. Appl. No. 13/306,527 [NOVLP440].

Chinese First Office Action dated Oct. 25, 2019 issued in Application No. CN 201920194037.0 [LAMRP426CNUM].

* cited by examiner

ONE-PIECE ANODE FOR TUNING ELECTROPLATING AT AN EDGE OF A SUBSTRATE

FIELD

The present disclosure relates generally to electroplating of metal layers on a semiconductor wafer. More particularly, it relates to active anodes used in electroplating apparatuses.

BACKGROUND

The transition from aluminum to copper in integrated circuit (IC) fabrication required a change in process "architecture" (to damascene and dual-damascene) as well as a whole new set of process technologies. One process step used in producing copper damascene circuits is the formation of a "seed-" or "strike-" layer, which is then used as a base layer onto which copper is electroplated ("electrofill"). The seed film is typically a thin conductive copper layer, though other conductive materials can be used depending on application. It is separated from the insulating silicon dioxide or other dielectric by a barrier layer. During electroplating the semiconductor wafer having the seed layer is typically immersed into an electrolyte containing copper ions and is cathodically (negatively) biased. An anode (such as an active copper anode) is positively biased and is usually located such that it directly faces the plating surface of the wafer substrate. In damascene processes the substrate has a number of recessed features coated with a conductive seed layer that is electrically connected to a power supply at the periphery of the substrate.

When an active (soluble) copper anode is used, the anode is dissolved during electroplating according to equation (1). The active anode can serve as a source of copper ions in the electrolyte.

$$Cu\text{-}2e^{-} \rightarrow Cu^{2+} \quad (1)$$

The copper ions contained in the electrolyte are reduced at the cathodically biased substrate, such that copper is electrodeposited according to equation (2).

$$Cu^{2+} + 2e^{-} \rightarrow Cu \quad (2)$$

Electrodeposition processes can also be used in Wafer Level Packaging (WLP) applications to fill larger recessed features than in typical damascene applications. In WLP applications, metal is typically electroplated into recessed features using a through-resist electroplating process, where the substrate includes both exposed non-conductive photoresist material and conductive seed layer (located at the bottom portions of recessed features) before electroplating.

The background description provided herein is for the purposes of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

During electroplating it is often desired to tune the amount of deposited metal at the edge of the substrate. This is accomplished in some embodiments by providing a secondary anode in addition to the primary anode, where the primary anode is disposed such that it directly faces the substrate, whereas the secondary anode is peripherally disposed, and may be controlled separately from the primary anode. In some embodiments the secondary anode has a generally annular shape with an inner diameter that is greater than the diameter of the substrate.

In one aspect an active anode is provided, wherein the active anode (e.g., a copper anode, a cobalt anode, or a nickel anode) has a generally annular body having an inner surface and an outer surface, and at least one protrusion extending outward from the outer surface, where the compositions of the generally annular body and of the at least one protrusion are the same. Such anode may serve as the secondary anode for tuning electroplating at the edge of the substrate. The protrusion can serve as a power coupling tab that can be electrically connected via cables to the power supply that supplies power to the anode. In some embodiments, the anode (including the annular body and the protrusion) is machined from a single sheet of anode-grade metal (e.g., copper, cobalt or nickel), such that there are no seams in the body of the anode. Advantageously, when both the annular body and the protrusion have the same composition, and when welding seams are absent in the anode, the anode can provide a stable plating environment without significant voltage fluctuations. In contrast, if fasteners of a different composition are attached to the annular body of the anode, or if the anode contains seams, increased dissolution of metal can occur near the seams or fasteners, leading to plating non-uniformities at these positions.

In some embodiments, the active anode is a single-piece copper anode. The single piece copper anode in some embodiments comprises copper (Cu) and phosphorus (P). In some implementations the single-piece copper anode comprises at least about 99.9% copper (±0.05%) and between about 400 ppm (±50 ppm) and about 650 ppm (±50 ppm) phosphorus by weight. The anode-grade copper in the copper anode in some embodiments has an average grain size of between about 150 μm (±50 μm) and about 450 μm (±50 μm). In other implementations, where cobalt is the electrodeposited metal, the anode is a single-piece cobalt anode.

In some embodiments, the protrusion of the active anode comprises an opening at a distal terminus of the protrusion. The opening is typically configured for fitting a power connector that is adapted to be connected to a power supply. The power connector is inserted into the opening in a direction that is perpendicular to the plane defined by the annular portion of the anode. In some cases, the distal terminus of the protrusion surrounding the opening is recessed. The recess allows the head of the power connector to rest against the protrusion, when the power connector is fitted into the opening.

The dimensions of the active anode can be selected based on the size of the substrate. In some embodiments (e.g., when processing a semiconductor wafer having a 300 mm diameter), the generally annular body of the active anode has an inner diameter of at least about 317.5 mm (±1 m) and an outer diameter of no larger than about 355.6 mm (±1 mm). In one example the generally annular body of the active anode has an inner diameter of about 330 mm (±5%) and an outer diameter of about 352 mm (±5%). The protrusion, in the depicted embodiment, has a maximum width of between about 8 mm and about 10 mm (e.g., about 9 mm). The annular body and the protrusion have maximum thickness of about 10 mm in this embodiment, whereas the length of the protrusion is between about 33 mm and about 37 mm. Unless stated otherwise, the term "about", when referring to dimensions is ±50% of the recited dimension value.

In one embodiment, the active anode is a single-piece copper anode, wherein the generally annular body of the single-piece copper anode has an inner diameter of at least about 318 mm and an outer diameter of no larger than about 355 mm. In this implementation the protrusion of the active anode has an opening at a distal terminus of the protrusion, wherein a distance between a center of an annulus defining the generally annular body and a center of the opening at the distal terminus of the protrusion is between about 197 and about 217 mm.

In another aspect an electroplating apparatus for electroplating a metal on a substrate, is provided. In some embodiments the apparatus includes: (a) a plating chamber configured to contain an electrolyte, the plating chamber comprising a catholyte compartment and an anolyte compartment, wherein the anolyte compartment and the catholyte compartment are separated by an ion-permeable membrane; (b) a substrate holder configured to hold and rotate the substrate in the catholyte compartment during electroplating; (c) a primary anode positioned in the anolyte compartment of the plating chamber; (d) an ionically resistive ionically permeable element positioned between the ion-permeable membrane and the substrate holder, wherein the ionically resistive ionically permeable element is adapted to provide ionic transport through the element during electroplating; and (e) a secondary anode configured to donate plating current to the substrate, wherein the secondary anode is positioned such that the donated current does not cross the ion-permeable membrane separating the anolyte and catholyte compartments, and wherein the secondary electrode is positioned such as to donate plating current through the ionically resistive ionically permeable element, wherein the secondary anode comprises a generally annular body having an inner surface and an outer surface; and at least one protrusion extending outward from the outer surface, wherein the active anode is a copper anode, cobalt anode, or a nickel anode, and wherein compositions of the generally annular body and of the at least one one protrusion of the secondary anode are the same. The secondary anode may be a single-piece copper anode, a single-piece cobalt anode, or a single-piece nickel anode as described herein.

The secondary anode is positioned in some embodiments in a secondary anode compartment around the periphery of the plating chamber. The protrusion of the anode is in some embodiments electrically connected to a power supply via a metal connector and a power supply cable. The metal connector (metal coupling) can be made of any suitable electrically conductive metal, such as titanium, stainless steel or copper.

In another aspect, a method of electroplating a metal on a cathodically biased substrate is provided. The method includes: (a) providing the substrate into an electroplating apparatus configured for rotating the substrate during electroplating, wherein the apparatus comprises: (i) a plating chamber configured to contain an electrolyte, the plating chamber comprising a catholyte compartment and an anolyte compartment, wherein the anolyte compartment and the catholyte compartment are separated by an ion-permeable membrane; (ii) a substrate holder configured to hold and rotate the substrate in the catholyte compartment during electroplating; (iii) a primary anode positioned in the anolyte compartment of the plating chamber; (iv) an ionically resistive ionically permeable element positioned between the ion-permeable membrane and the substrate holder, wherein the ionically resistive ionically permeable element is adapted to provide ionic transport through the element during electroplating; and (v) a secondary anode configured to donate plating current to the substrate, wherein the secondary anode is positioned such that the donated and/or diverted plating current does not cross the ion-permeable membrane separating the anolyte and catholyte compartments and wherein the secondary anode is positioned such as to donate plating current through the ionically resistive ionically permeable element, wherein the secondary anode comprises a generally annular body having an inner surface and an outer surface; and at least one protrusion extending outward from the outer surface, wherein the active anode is a copper anode, cobalt anode, or a nickel anode, and wherein compositions of the generally annular body and of the at least one one protrusion of the secondary anode are the same; and (b) electroplating the metal on the substrate while rotating the substrate, and while providing power to the secondary anode and the primary anode.

In some embodiments, any of the methods described herein are used in conjunction with photolithographic device processing. For example, the methods may further involve applying photoresist to the substrate; exposing the photoresist to light; patterning the photoresist and transferring the pattern to the substrate; and selectively removing the photoresist from the substrate. In some embodiments, a system is provided, wherein the system includes any of the apparatuses described herein and a stepper.

The apparatuses described herein further typically include a controller comprising program instructions or built-in logic for performing any of the electroplating methods described herein. In another aspect, a non-transitory computer machine-readable medium is provided to control the apparatus provided herein. The machine-readable medium comprises code to perform any of the methods described herein.

These and other features and advantages of the present disclosure will be described in more detail below with reference to the associated drawings.

DETAILED DESCRIPTION

Figure 1A:
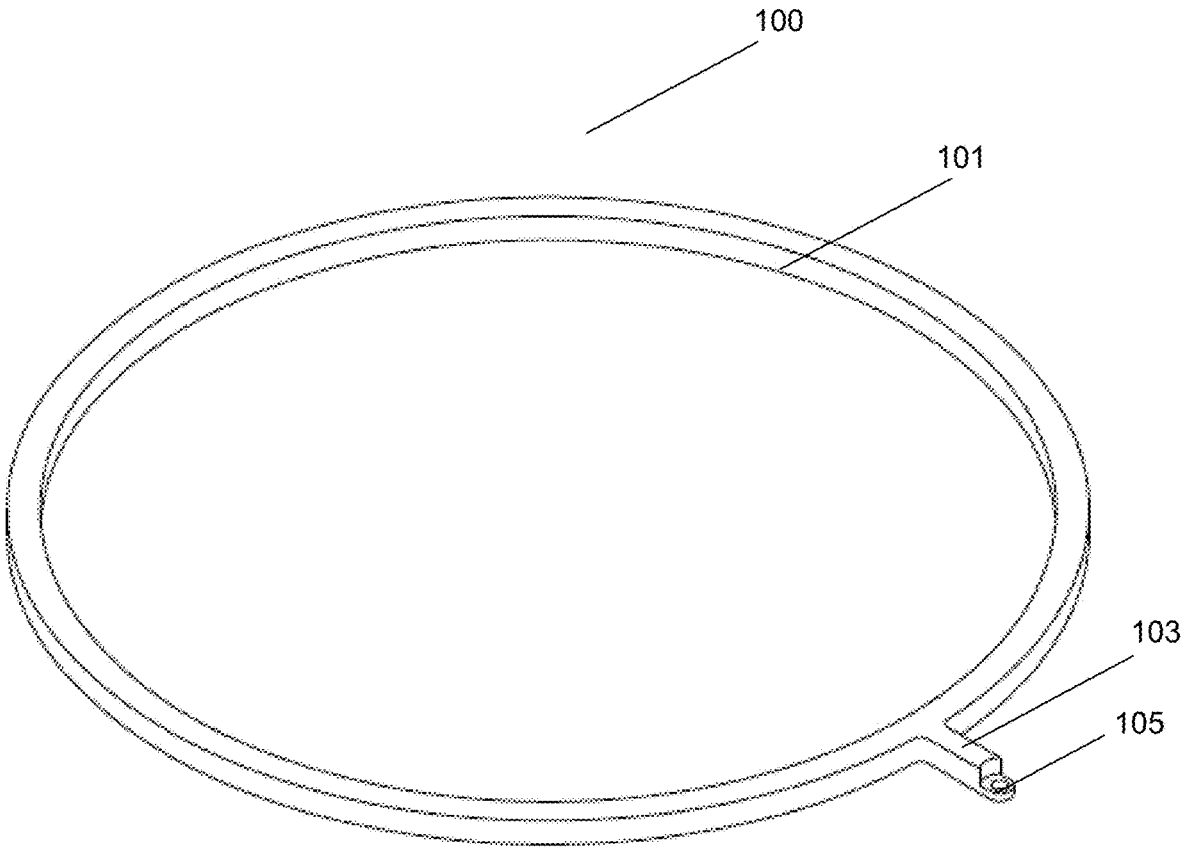
FIG. 1A shows a view of an anode, according to an embodiment provided herein.

An anode for modulating electroplating at a periphery of a substrate is provided. The provided anode is a secondary anode that is typically peripherally disposed in a plating chamber, and is used for electroplating in conjunction with a more centrally disposed main anode. The provided secondary anode is configured to be positively biased at least during a portion of the total electroplating time, and to provide plating current to the substrate. The anode, as used herein, does not need to be positively biased during the entire course of electroplating, and, in some embodiments, remains unbiased during a portion of the total electroplating time. In some embodiments, the anode is positively biased during a portion of electroplating time, and is negatively biased (serves as a thief cathode) during another portion of the electroplating time. In some embodiments the amount of plating current provided by the secondary anode is dynamically varied during the course of electroplating. While the provided anode is typically referred to as a secondary anode, it does not necessarily provide smaller current than the main anode at all times during electroplating.

The provided secondary anode is an active anode, which dissolves during electroplating and can serve as a source of metal ions that are being plated onto the substrate. For example during electrodeposition of copper, a copper secondary anode is used. A cobalt anode is used for electrodeposition of cobalt, and a nickel anode is used for electrodeposition of nickel. In some embodiments the copper anode comprises at least 95%, such as at least 99% copper by weight, a cobalt anode comprises at least 95%, such as at least 99% cobalt by weight, and a nickel anode comprises at least 95% such as at least 99% nickel by weight. For example, the copper anode can be made from anode-grade copper that includes copper and phosphorus, where the content of copper is at least about 99.9% by weight and the content of phosphorus is between about 400 and about 650 ppm. In some embodiments the anode-grade copper is also characterized by an average copper grain size of between about 150 and about 450 μm.

In one of the preferred implementations the secondary anode has a generally annular body having an inner surface and an outer surface and at least one protrusion extending from the outer surface, where the compositions of the generally circular body and of the protrusion are the same. For example, both the annular body and the protrusion can be made of an anode-grade copper as described above. The protrusion is configured for making an electrical connection with the power supply, and in many embodiments is not substantially dissolved during electroplating as its contact with the electrolyte may be limited or prevented by a dielectric cover. However, even when the protrusion does not actively serve as the source of the plating current it is advantageous for it to have the same composition as the ring-shaped portion because this configuration results in reduced voltage fluctuations and, consequently, in improved plating uniformity. If a charge coupling that is made of a different metal is attached directly to a copper anode ring by fasteners, the copper adjacent to the charge coupling can dissolve at a faster rate than elsewhere on the anode ring, leading to non-uniform electrodeposition of copper. For that reason, the charge coupling in the illustrated embodiment is incorporated into the body of the anode as a protrusion extending outward from the anode ring.

Further, in some embodiments the anode is a single-piece anode. The single-piece anode does not include any seams (such as welding seams) or fasteners and is typically machined from a single sheet of metal. For example a single-piece copper anode can be machined from a single sheet of anode-grade copper. It was discovered that the uniformity of plating current, and consequently, uniformity of plating can be significantly improved when seamless single-piece anodes are used, because seams can lead to voltage fluctuations. In some embodiments, the one-piece anode is machined from a sheet of anode-grade metal, such as anode-grade copper, anode-grade cobalt, or anode-grade nickel.

Figure 1B:
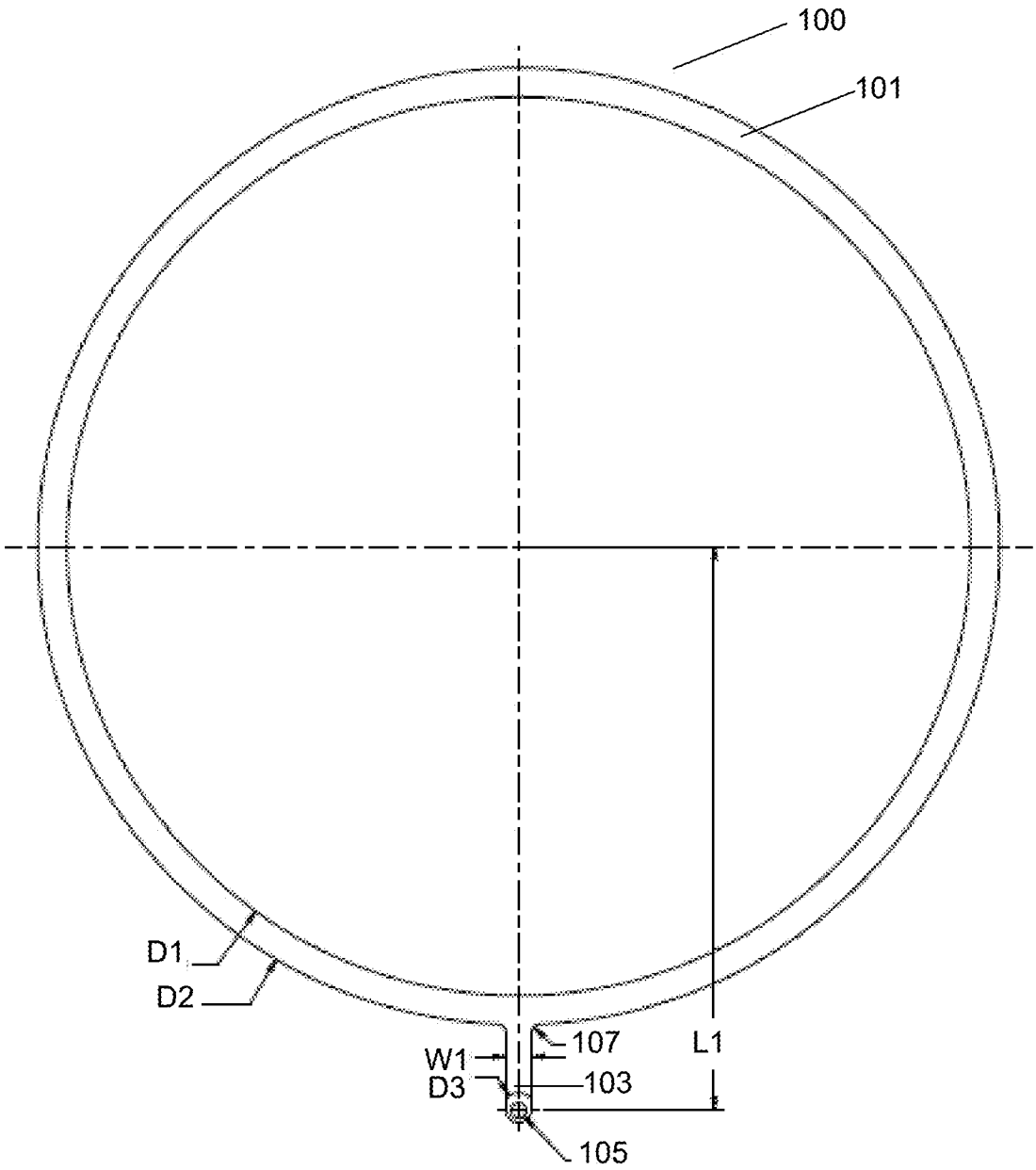
FIG. 1B shows a top view of the anode illustrated in FIG. 1A.
Figure 1C:
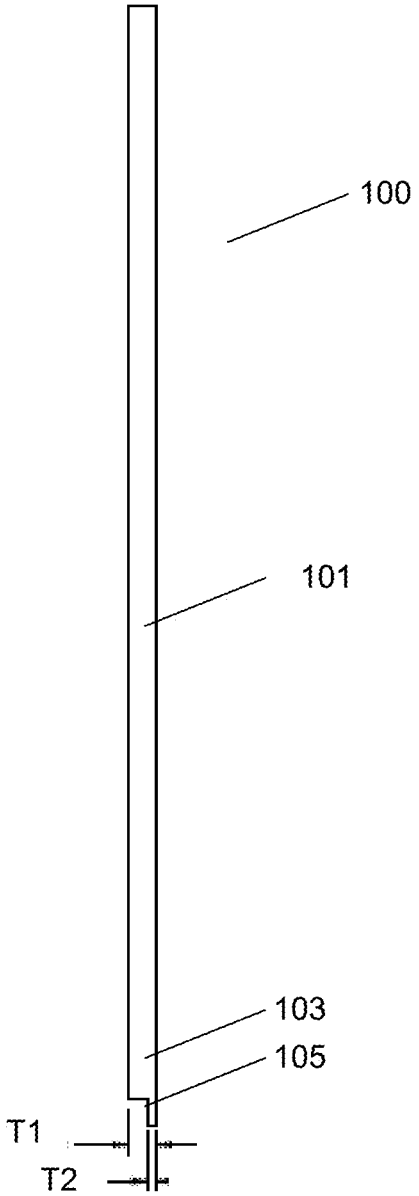
FIG. 1C shows a side view of the anode illustrated in FIG. 1A.

An exemplary single-piece anode is illustrated by FIGS. 1A-1C. FIG. 1A shows a view of a one-piece anode 100, where the anode includes an generally annular body 101 and a charge coupling protrusion 103 that extends in an outward direction. In the depicted embodiment, the charge-coupling protrusion 103 has an opening 105 at the distal end of the protrusion 103. The opening lies in the same plane as the opening inside the annular portion of the anode, and is configured to be fitted with a charge coupling connector that can be inserted into the opening and electrically connected with the power supply. The opening 105 on the protrusion 103 is surrounded by a recessed portion in the depicted embodiment that allows the head of the connector to rest on the protrusion 103.

A top view of the single-piece anode illustrated in FIG. 1A is shown in FIG. 1B. The annular body of the anode 103 and the charge coupling protrusion 105 are machined from a single piece of metal without seams or fasteners at the interface 107 between the annular body 103 and the charge coupling protrusion 105. The dimensions of the one-piece anode 100, illustrated in FIG. 1B include the inner diameter D1, the outer diameter D2 and the width of the charge coupling protrusion W1. The recess on the charge compling protrusion in the illustrated embodiment has an arc-shaped border, characterized by diameter, D3, which refers to a double distance from the center of the opening 105 to the arc-shaped border. The inner diameter D1 and the outer diameter D2 of the anode 100 refer respectively to the inner diameter and the outer diameter of the annular body 103. The width W1 of the charge coupling protrusion refers to the width of the protrusion in a plane of the annular opening of the anode. Further, FIG. 1B illustrates L1, which is the distance between the center of the annular body 103 and the center of the opening 105 at the distal end of the charge coupling protrusion 103.

FIG. 1C shows a side view of the one-piece anode. In this view the recessed portion of the charge coupling protrusion 103 is more clearly visible. In the depicted embodiment the thickness T1 of the annular body 101 of the anode 103 is the same as the thickness of the protrusion 103 that is adjacent to the annular body 101. At the distal end of the protrusion the the protrusion is recessed to a smaller thickness T2. Thicknesses T1 and T2 refer to distances in a plane that is perpendicular to the plane of the opening defined by the annular portion of the anode.

The dimensions of the secondary anode can vary depending on the size of the substrate that is being processed. In many embodiments, the inner diameter of the anode is greater than the diameter of the substrate, and the anode is disposed in the plating apparatus, such that the substrate has no footprint onto the secondary anode. The described anodes can be used for electroplating on a variety of semiconductor substrates, including semiconductor wafers with diameters of 250 mm, 300 mm, or 450 mm.

Table 1 lists exemplary dimensions of an anode that can be used for tuning electroplating at the edge of a 300 mm wafer substrate.

TABLE 1

| Anode dimensions in accordance with an embodiment provided herein. | |
|---|---|
| D1 | about 330 mm |
| D2 | about 352 mm |
| W1 | about 9 mm |
| D3 | about 13 mm |
| L1 | about 207 mm |
| T1 | about 10 mm |
| T2 | about 3 mm |
| Diameter of the opening at the distal part of the protrusion | about 6 mm |

In some embodiments the inner diameter of the annular body of the anode is at least 317.5 mm and the outer diameter is not greater than 355.6 mm. In these embodiments the width of the annular body of the anode (in the same plane as the opening of the annular portion) is less than about 38 mm. In some embodiments the protrusion has a maximum width of between about 8 mm and about 10 mm. In some embodiments the maximum thickness of the annular body of the anode and of the charge coupling protrusion is about 10 mm. In some embodiments a distance between a center of an annulus defining the generally annular body and a center of the opening at the distal terminus of the protrusion is between about 197 mm and about 217 mm, and the length of the protrusion is between about 33 and about 37 mm.

The provided anode is configured to donate plating current to the periphery of the substrate at least during a portion of total electroplating time, and can be used to correct plating non-uniformity at the edge of the substrate.

The seed layer on the wafer substrate carries the electrical current from the edge region of the wafer (where electrical contact is typically made) to all trenches and via structures located across the wafer surface. Because electrical contact is made at the edge of the wafer, greater thickness of electrodeposited copper is often observed at the edge regions of the wafer than at the center of the wafer. This is referred to as a terminal effect, and is one example of plating non-uniformity encountered during electrofill. As the plating progresses, the terminal effect becomes less pronounced. If at the beginning of the plating, the apparatus is configured to mitigate the terminal effect and reduce the thickness of plated metal at the edge of the substrate, as the plating progresses it may be advantageous to introduce additional plating current at the edge of the substrate, e.g., using the secondary anode provided herein.

The provided anode can be used for electroplating metal on substrates having recessed features, such as damascene features (e.g., features with sizes of 10-200 nm), wafer level packaging (WLP) features and through silicon vias (TSV). WLP and TSV technologies present their own very significant challenges.

Generally, the processes of creating TSV are loosely akin to damascene processing but are conducted at a different, larger size scale and utilize higher aspect ratio recessed features. In TSV processing a cavity or a recess is first etched into a dielectric layer (e.g. a silicon dioxide layer); then both the internal surface of the recessed feature and the field region of the substrate are metallized with a diffusion barrier and/or adhesion (stick) layer (e.g. Ta, Ti, TiW, TiN, TaN, Ru, Co, Ni, W), and an "electroplateable seed layer" (e.g. Cu, Ru, Ni, Co, that can be deposited for example by physical vapor deposition (PVD), chemical vapor deposition (CVD), ALD, or electroless plating processes). Next, the metallized recessed features are filled with metal, using, for example, "bottom up" copper electroplating. In contrast, through resist WLP feature formation typically proceeds differently. The process typically starts with a substantially planar substrate that may include some low aspect ratio vias or pads. The substantially planar dielectric substrate is coated with an adhesion layer followed by a seed layer (typically deposited by PVD). Then a photoresist layer is deposited and patterned over the seed layer to create a pattern of open areas, free of plating-masking photoresist in which the seed layer is exposed. Next, metal is electroplated into the open areas to from a pillar, line, or another feature on the substrate, which, after stripping of the photoresist, and removal of the seed layer by etching, leaves various electrically isolated embossed structures over the substrate.

Both of these technologies (TSV and through resist plating) require electroplating on a significantly larger size scale than damascene applications. Depending on the type and application of the packaging features (e.g. through chip connecting TSV, interconnection redistribution wiring, or chip to board or chip bonding, such as flip-chip pillars), plated features are usually, in current technology, greater than about 2 micrometers in diameter and typically are 5-100 micrometers in diameter (for example, pillars may be about 50 micrometers in diameter). For some on-chip structures such as power busses, the feature to be plated may be larger than 100 micrometers. The aspect ratios of the through resist WLP features are typically about 2:1 (height to width) or lower, more typically 1:1 or lower, while TSV structures can have very high aspect ratios (e.g., in the neighborhood of about 10:1 or 20:1).

Given the relatively large amount of material to be deposited, not only feature size, but also plating speed differentiates WLP and TSV applications from damascene applications. For many WLP applications, plating must fill features at a rate of at least about 2 micrometers/minute, and typically at least about 4 micrometers/minute, and for some applications at least about 7 micrometers/minute. The actual rates will vary depending on the particular metal being deposited. But at these higher plating rate regimes, efficient mass transfer of metal ions in the electrolyte to the plating surface is very important. Higher plating rates present numerous challenges with respect to maintaining suitable feature shape, as well as controlling the die and wafer scale thickness uniformity.

Another uniformity control challenge is presented by dissimilar substrates that may need to be sequentially processed in one electroplating tool. For example, two different semiconductor in-process wafers, each targeted for a different product, may have a substantially different radial distribution of recessed features near the edge region of the semiconductor wafer, and therefore would require different compensations to achieve the desired uniformity for both. Therefore, there is a need for an electroplating apparatus that will be capable to sequentially process dissimilar substrates with excellent plating uniformity and minimal plating tool downtime.

Methods and apparatus for electroplating a metal on a substrate while controlling uniformity of the electroplated layer, such as radial uniformity, are provided. The methods are also useful for sequentially electroplating metal on dissimilar substrates, such as on semiconductor wafers having different patterns or distribution of recessed features on the surface. The methods, in some embodiments, control plating current (ionic current) at the substrate using a remotely positioned secondary anode.

Embodiments are described generally where the substrate is a semiconductor wafer; however the disclosure is not so limited. Provided apparatus and methods are useful for electroplating metals in TSV and WLP applications, but can also be used in a variety of other electroplating processes, including deposition of copper or cobalt in damascene features. Examples of metals that can be electroplated using provided methods include, without limitation, copper, cobalt, and nickel.

In a typical electroplating process, the semiconductor wafer substrate, which may have one or more recessed features on its surface is placed into the wafer holder, and its platable (working) surface is immersed into an electrolyte contained in the electroplating bath. The wafer substrate is biased negatively, such that it serves as a cathode during electroplating. The ions of the platable metal (such as ions of metals listed above) which are contained in the electrolyte are being reduced at the surface of the negatively biased substrate during electroplating, thereby forming a layer of plated metal. The wafer, which is typically rotated during electroplating, experiences an electric field (ionic current field of the electrolyte) that may be non-uniform for a variety of reasons. This may lead to non-uniform deposition of metal. One of the types of non-uniformity is center-to-edge (or radial) non-uniformity, which manifests itself in different thicknesses of plating at different radial positions on the wafer at the same azimuthal (angular) position. Radial non-uniformity may arise from the terminal effect, due to greater amount of metal being deposited in the vicinity of electrical contacts on the wafer substrate. Because electrical contacts are made at the periphery of the wafer, around the edge of the wafer, the resistance to the flow of current in the metal seed layer, referred to as the "terminal effect", manifests itself in thicker plating at the edge of the wafer substrate in comparison to the center of the substrate. One of the methods that can diminish the radial non-uniformity due to terminal effect is the use of an ionically resistive ionically permeable element positioned in close proximity of the substrate, wherein the element has an ionically permeable (e.g., porous) region that terminates at a particular radial location from the center of the element and an ionically impermeable region beyond the selected radial location. This results in inhibiting flow of ionic current through the element beyond that selected radius because the element is not permeable there. Another method, used alone or in combination, is the placement of an annular shield that blocks or diverts the plating current from the edge of the wafer substrate to a more central location.

However, in many cases, dissimilar substrates, e.g., substrates that have a different distribution of recessed features on their surface will experience different distribution of plating current at their surface and may require different shields to reduce non-uniformity. For example, one semiconductor wafer may include an outer region that is not platable and is covered with photoresist, and a central region that contains platable recessed features. A second, dissimilar wafer may have platable features substantially all over the wafer. When such dissimilar wafers are processed sequentially using one electroplating tool, a radial non-uniformity problem is encountered. If the tool uses an annular shield having an opening optimized for uniform plating of the wafer second wafer, the use of the same tool for electroplating on the first wafer will result in edge-thick plating about the perimeter of the region of platable features, because of current crowding at this region due to the presence of the unplatable outer region. In order to compensate for this effect, an annular shield having a smaller diameter of the opening should be used when processing the first wafer. Thus, when the first and second wafers are processed sequentially, the shields having different diameters of the central opening need to be sequentially used in order to achieve optimal non-uniformity in a conventional approach. For example, when a 300 mm wafer is used, a shield having a diameter of an inner opening of 11.45 inches (290.8 mm) may be used for processing a "full face exposed" first wafer, while a shield having a diameter of an inner opening of 10.80 inches (274.3 mm) would be well suited for processing the second wafer that has a region of unpatterned photoresist at the edge. This change of shielding size and shielding element, however, is undesired and is not practical because change in the tool hardware requires significant operator intervention and associated unproductive tool downtime. Therefore there is a need for an apparatus that would be capable of processing dissimilar wafers without the necessity of manual intervention such as shield changes or other hardware modifications. More generally, dissimilar wafers that can be processed with apparatuses and methods provided herein include wafers having different resistivities of seed layers, and different distributions of recessed features. In some embodiments, the differences between the wafers affect only radial uniformity.

An appropriately positioned second anode that is configured to donate plating current to the wafer substrate is used to modulate plating uniformity in the embodiments provided herein. In some embodiments the anode can be negatively biased during a portion of the total electroplating time, and serve as a thief cathode, and can be positively biased during another portion of the plating time. The position of the anode in relation to other components of the electroplating system is significant for a number of reasons including minimization of the manufacturing complexity and cost, improvement of reliability, and ease of assembly and maintenance. Two main configurations of an electroplating apparatus are shown. The configurations illustrate how the secondary anode can be integrated into an electroplating system containing anolyte and catholyte compartments that are separated by a membrane. The configurations further show how a secondary electrode can be integrated with an ionically resistive ionically permeable element, such as a channeled ionically resistive plate (CIRP) positioned in the proximity of the substrate. Both configurations can be implemented in a Sabre 3D™ system available from Lam Research Corporation.

Anolyte and Catholyte Portions of a Plating Vessel

In both configurations of the apparatus provided herein the electroplating apparatus includes a plating chamber configured to hold electrolyte, where the plating chamber is separated by an ion-permeable membrane into anolyte and catholyte compartments. The primary anode is housed in the anolyte portion, while the substrate is immersed into the electrolyte in the catholyte portion across the membrane. The compositions of anolyte (electrolyte in the anolyte compartment) and catholyte (electrolyte in the catholyte compartment) can be the same or different.

The membrane allows ionic communication between the anolyte and catholyte regions of the plating cell, while preventing the particles generated at the primary anode from entering the proximity of the wafer and contaminating it. In some embodiments, the membrane is a nanoporous membrane (including but not limited to reverse osmosis membrane, a cationic or anionic membrane) that is capable of substantially preventing physical movement of the solvent and of dissolved components under the influence of pressure gradients, while allowing relatively free migration of one or more charged species contained in the electrolyte via ion migration (motion in response to the application of an electric field). Ion exchange membranes, such as cationic exchange membranes are especially suitable for these applications. These membranes are typically made of ionomeric materials, such as perfluorinated co-polymers containing sulfonic groups (e.g. Nafion), sulfonated polyimides, and other materials known to those of skill in the art to be suitable for cation exchange. Selected examples of suitable Nafion membranes include N324 and N424 membranes available from Dupont de Nemours Co. The membrane separating catholyte and anolyte may have different selectivity for different cations. For example, it may allow passage of protons at a faster rate than the passage rate of metal ions (e.g. cupric ions).

Electroplating apparatus having membrane-separated catholyte and anolyte compartments achieves separation of catholyte and anolyte and allows them to have distinct compositions. For example, organic additives can be contained within catholyte, while the anolyte can remain essentially additive-free. Further, anolyte and catholyte may have differing concentrations of metal salt and acid, due, for example, to ionic selectivity of the membrane.

In both configurations of the electroplating apparatus illustrated herein, the secondary anode is positioned such that the plating current donated by the secondary anode is not passed through the membrane separating the anolyte and catholyte portions of the plating chamber.

Ionically Resistive Ionically Permeable Element

In both configurations of the apparatus illustrated herein, the apparatus includes an ionically resistive, ionically permeable element positioned in a close proximity of the substrate in the catholyte compartment of the plating chamber. This allows for free flow and transport of electrolyte though the element, but introduces a significant ionic resistance into the plating system, and may improve center-to-edge (radial) uniformity. In some embodiments, the ionically resistive ionically permeable element further serves as a source of electrolyte flow that exits the element in a direction that is substantially perpendicular to the working face of the substrate (impinging flow), and primarily functions as a flow-shaping element. In some embodiments the element includes channels or holes that are perpendicular to the platable surface of the wafer substrate. In some embodiments the element include channels or holes that are at an angle that is different from 90 degrees relative to the platable surface of the wafer substrate. A typical ionically resistive ionically permeable element accounts for 80% or more of the entire voltage drop of the plating cell system. In contrast, the ionically resistive ionically permeable element has very little fluid flow resistance and contributes very little to the pressure drop of the cell and ancillary supporting plumbing network system. This is due to the large superficial surface area of the element (e.g., about 12 inches in diameter or 700 $cm^2$) and modest porosity and pore sizes (e.g. the element may have a porosity of about 1-5% created by an appropriate number of drilled channels (also referred to as pores or holes) that may have a diameter of about 0.4 to 0.8 mm. For example, the calculated pressure drop for flowing 20 liters/minute through a porous plate having a porosity of 4.5% and thickness of 0.5 inches (e.g., a plate comprising 9600 drilled holes with 0.026" diameter) is less than 1 inch of water pressure (equal to approximately 0.036 psi).

Generally the ionically resistive ionically permeable element may include pores that form interconnecting channels within the body of the element but in many embodiments it is more preferable to use an element that has channels that do not interconnect within the body of the element (e.g., use a plate with non-interconnected drilled holes). The latter embodiment is referred to as channeled ionically resistive plate (CIRP). Two features of the CIRP are of particular importance: the placement of the CIRP in close proximity with respect to the substrate, and the fact that through-holes in the CIRP are spatially and ionically isolated from each other and do not form interconnecting channels within the body of the CIRP. Such through-holes will be referred to as 1-D through-holes because they extend in one dimension, often, but not necessarily, normal to the plated surface of the substrate (in some embodiment the 1-D holes are at an angle with respect to the wafer which is generally parallel to the CIRP front surface). These through-holes are distinct from 3-D porous networks, where the channels extend in three dimensions and form interconnecting pore structures. An example of a CIRP is a disc made of an ionically resistive material, such as polyethylene, polypropylene, polyvinylidene difluoride (PVDF), polytetrafluoroethylene, polysulphone, polyvinyl chloride (PVC), polycarbonate, and the like, having between about 6,000-12,000 1-D through-holes. The disc, in many embodiments, is substantially coextensive with the wafer (e.g., has a diameter of about 300 mm when used with a 300 mm wafer) and resides in close proximity of the wafer, e.g., just below the wafer in a wafer-facing-down electroplating apparatus. Preferably, the plated surface of the wafer resides within about 10 mm, more preferably within about 5 mm of the closest CIRP surface. In the second configuration of an apparatus that will be described herein the CIRP includes at least three segments: an inner segment configured to pass plating current from the primary anode, an outer segment configured to pass current from the secondary anode, and a dead zone between the inner and outer segments that electrically isolates the inner and outer segments from each other and does not allow the plating currents from the primary anode and the secondary anode to mix before they enter the CIRP or within the body of the CIRP.

The presence of a resistive but ionically permeable element close to the substrate substantially reduces the impact of and compensates for the terminal effect and improves radial plating uniformity. It also simultaneously provides the ability to have a substantially spatially-uniform impinging flow of electrolyte directed upwards at the wafer surface by acting as a flow diffusing manifold plate. Importantly, if the same element is placed farther from the wafer, the uniformity of ionic current and flow improvements become significantly less pronounced or non-existent. Further, because 1-D through-holes do not allow for lateral movement of ionic current or fluid motion within the CIRP, the center-to-edge current and flow movements are blocked within the CIRP, leading to further improvement in radial plating uniformity.

Another important feature of the CIRP structure is the diameter or principal dimension of the through-holes and its relation to the distance between the CIRP and the substrate. Preferably the diameter of each through-hole (or of majority of through-holes), should be no more than the distance from the plated substrate surface to the closest surface of the CIRP. Thus, the diameter or principal dimension of the through holes should not exceed 5 mm, when CIRP is placed within about 5 mm of the plated wafer surface.

In some embodiments the ionically resistive ionically permeable element (e.g., a CIRP) has a top surface that is parallel to the plated surface of the substrate. In other embodiments, the top surface of the ionically resistive ionically permeable element is concave or convex.

The apparatus is also configured such that the flow of the plating fluid backwards through the ionically resistive element is substantially prevented, even when the plating fluid is injected in a direction that is substantially parallel to the surface of the ionically resistive ionically permeable element. It is important to note that motion of incompressible fluids, such as water, involves various levels of scaling and balance of inertial and viscous forces. Considering the fluid dynamic Navier-Stokes equations and the fact that fluid flow behavior is governed by tensor (vector) equations with important inertial terms, one can understand that enabling the plating liquid to flow through the ionically resistive ionically permeable element from a manifold below and "upwards" through it may be facile (since low pressure is required to obtain a substantial amount of flow), but in contrast, fluid flowing parallel to the surface may have very little tendency and a "high resistance" to passing though the porous material at the same static pressure. Changing the direction of movement of fluid at a right angle from rapid movement parallel to the surface to movement that is normal to the surface, involves the deceleration of the fluid and viscous dissipation of energy in the fluid, and therefore can be highly unfavorable. With that background, in other embodiments of this disclosure, the ionically resistive ionically permeable element has peripheral ancillary means (e.g. a fluid injector) for moving the fluid at a relatively high velocity in the direction parallel to the axis parallel to the wafer and CIRP surface, said CIRP element substantially preventing fluid from moving through the element and transiting to the exit side of elements' channels by passing into the element, through a manifold below the element and above the membrane, and then back through the element near the cross-flow exhaust side of the cell. In other words, the presence of the ionically resistive ionically permeable element combined with its pore size, porosity and parallel flow velocity, can prevent such a circumvention of the parallel flow form happening. Without wishing to be bound by any particular model or theory, it is believed that high velocity fluid has substantial amount of inertia in the direction of motion parallel to the ionically resistive element, would need to be decelerated and turn at right angle to enter the pores of the element, and as such, the ionically resistive element largely acts as a very good barrier preventing fluid from changing direction and passing through it. The two configurations of the electroplating apparatus provided herein differ in the position of the secondary anode with respect to the ionically resistive ionically permeable element. In accordance with the first configuration provided herein, the secondary anode as described herein is positioned such as to donate plating current to the substrate without passing the donated current through the ionically resistive ionically permeable element (e.g., a CIRP) and through the membrane separating the anolyte and catholyte compartments. This configuration is primarily used to control radial uniformity, but can additionally have the capability of azimuthal uniformity control, e.g., with the use of an additional azimuthally asymmetric or segmented tertiary electrode.

Example of a First Configuration of an Electroplating Apparatus

An illustration of a plating system of a first configuration, which employs both a resistive element in close proximity to the wafer, a membrane separating anolyte and catholyte compartments, and a secondary anode is shown in FIG. 2. This is one example of a plating system, and it is understood that the plating system can be modified within the spirit and scope of appended claims. For example, an annular shield need not be present in all embodiments, and when present, the shield may be positioned below the CIRP, above the CIRP, or can be integrated with the CIRP.

Figure 2A:
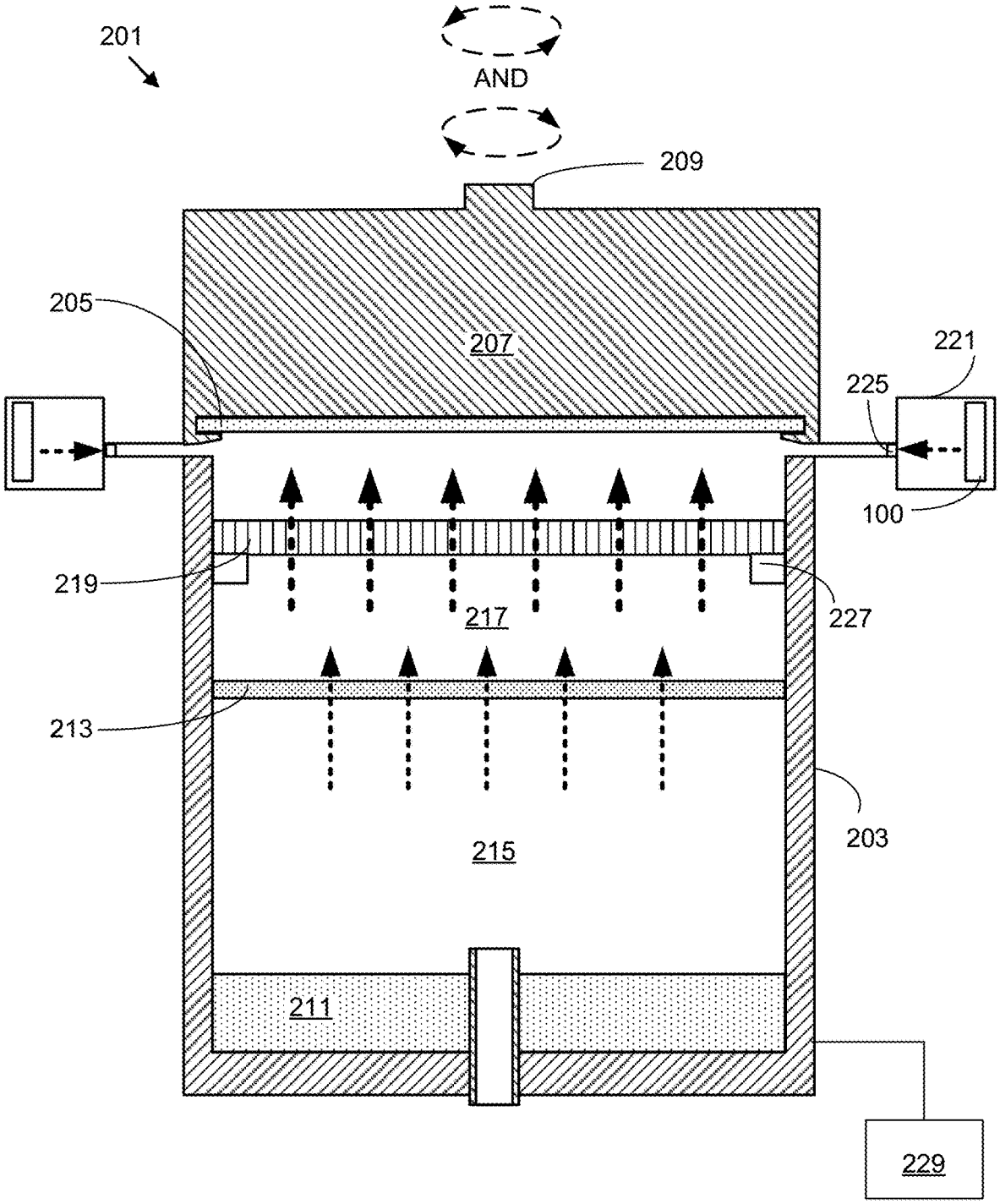
FIG. 2A is a schematic cross-sectional view of an electroplating apparatus in accordance with a first configuration provided herein.

Referring to FIG. 2A, a diagrammatical cross-sectional view of an electroplating apparatus 201 is shown. The plating vessel 203 contains the plating solution, which typically includes a source of metal ions and an acid. A wafer 205 is immersed into the plating solution and is held by a "clamshell" holding fixture 207, mounted on a rotatable spindle 209, which allows bidirectional rotation of clamshell 207 together with the wafer 205. A primary anode 211 (which may be an inert or a consumable anode) is disposed below the wafer within the plating bath 203 and is separated from the wafer region by a membrane 213, preferably an ion selective membrane. The region 215 below the anodic membrane is often referred to as an "anode chamber" or "anolyte compartment" and electrolyte within this chamber as "anolyte". The region 217 above the membrane 213 is referred to as a "catholyte compartment". The ion-selective anode membrane 213 allows ionic communication between the anodic and cathodic regions of the plating cell, while preventing the particles generated at the anode from entering the proximity of the wafer and contaminating it and/or undesireable chemical species, present in the catholyte electrolyte, from coming into contact with the anode 211.

The plating solution is continuously provided to plating bath 203 by a pump (not shown). In some embodiments, the plating solution flows upwards through the membrane 213 and the CIRP 219 (or other ionically resistive ionically permeable element) located in close proximity of the wafer. In other embodiments, such as when the membrane 213 is largely impermeable to flow of the plating fluid (e.g. a nanoporous media such as a cationic membrane), the plating fluid enters the plating chamber between the membrane 213 and CIRP 219, for example at the chamber periphery, and then flows through the CIRP. In this case, plating fluid within the anode chamber may be circulated and the pressure can be regulated separately from the CIRP and cathode chamber.

A secondary anode chamber 221, housing the secondary anode 100 is located on the outside of the plating vessel 203 and peripheral to the wafer. In certain embodiments, the secondary anode chamber 221 is separated from the plating bath 203 by a wall having multiple openings (a membrane support structure) covered by an ion-permeable membrane 225. The membrane allows ionic communication between the plating cell and the secondary anode chamber, thereby allowing the plating current to be donated by the second anode. The porosity of this membrane is such that it does not allow particulate material to cross from the secondary anode chamber 221 to the plating bath 203 and result in the wafer contamination. Other mechanisms for allowing fluidic and/or ionic communication between the secondary anode chamber and the main plating vessel are within the scope of this disclosure. Examples include designs in which the membrane, rather than an impermeable wall, provides most of the barrier between plating solution in the second cathode chamber and plating solution in the main plating vessel. A rigid framework may provide support for the membrane in such embodiments.

Additionally, one or more shields, such as an annular shield 227 can be positioned within the chamber. The shields are usually ring-shaped dielectric inserts, which are used for shaping the current profile and improving the uniformity of plating. Of course other shield designs and shapes may be employed as are known to those of skill in the art.

In general, the shields may take on any shape including that of wedges, bars, circles, ellipses and other geometric designs. The ring-shaped inserts may also have patterns at their inside diameter, which improve the ability of the shields to shape the current flux in the desired fashion. The function of the shields may differ, depending on their position in the plating cell. The apparatus can include any of the static shields, as well as variable field shaping elements.

Two DC power supplies (not shown) can be used to control current flow to the wafer 205, the primary anode 211 and to the secondary anode 100 respectively. Alternatively, one power supply with multiple independently controllable electrical outlets can be used to provide different levels of current to the wafer and to the secondary anode. The power supply or supplies are configured to negatively bias the wafer 205 and positively bias the primary anode 211 and secondary anode 100. The apparatus further includes a controller 229, which allows modulation of current and/or potential provided to the elements of electroplating cell. The controller may include program instructions specifying current and voltage levels that need to be applied to various elements of the plating cell, as well as times at which these levels need to be changed. For example, it may include program instructions for supplying power to the secondary anode, and, optionally for dynamically varying the power supplied to the secondary anode during electroplating.

Arrows show the plating current in the illustrated apparatus. Current originating from the primary anode is directed upward, passes through the membrane separating anolyte and catholyte compartments and the CIRP. Current originating from the secondary anode is directed from the periphery of the plating vessel to the center and does not pass through the membrane separating the anolyte and catholyte compartments and the CIRP.

The apparatus configuration described above is an illustration of one embodiment of the present disclosure. Those skilled in the art will appreciate that alternative plating cell configurations that include an appropriately positioned secondary anode may be used. While shielding inserts are useful for improving plating uniformity, in some embodiments they may not be required, or alternative shielding configurations may be employed. In the described configuration the plating vessel and the primary anode are substantially coextensive with the wafer substrate. In other embodiments, the diameter of the plating vessel and/or of the primary anode may be smaller than the diameter of the wafer substrate, e.g., at least about 5% smaller.

Example of a Second Configuration of an Electroplating Apparatus

Figure 2B:
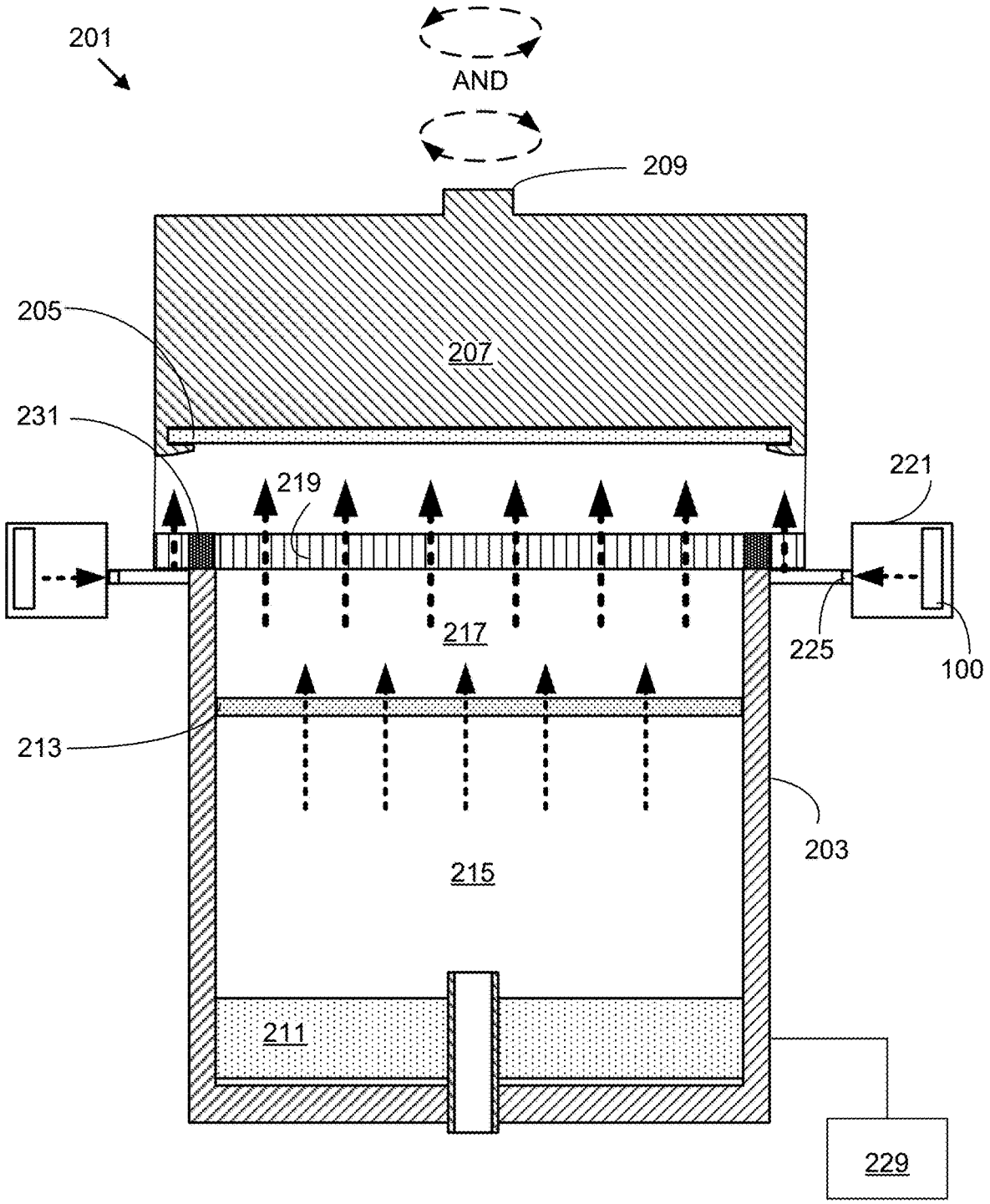
FIG. 2B is a schematic cross-sectional view of an electroplating apparatus in accordance with a second configuration provided herein.
Figure 3:
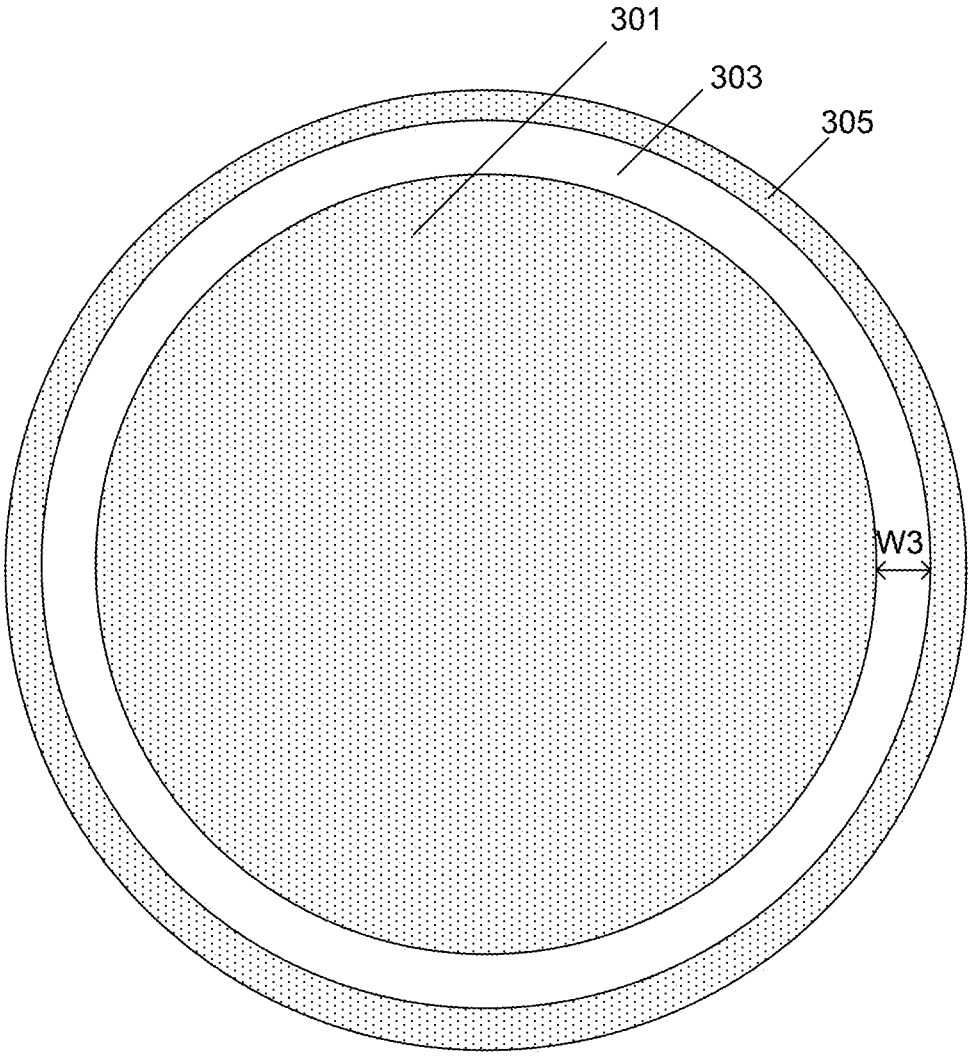
FIG. 3 shows a top view of a segmented ionically resistive ionically permeable element, in accordance with one embodiment provided herein.

In a second configuration of an apparatus provided herein, the secondary anode is positioned, such that the current donated by such anode does not pass through the membrane separating the anolyte and catholyte compartments, but passes through the ionically resistive ionically permeable element. A second configuration of the electroplating apparatus is illustrated in FIG. 2B. In the illustration shown in FIG. 2B, the secondary anode 100 is positioned in a secondary anode chamber 221 around the periphery of the plating vessel 203. The secondary anode chamber is in ionic communication with the catholyte portion of the plating vessel, such that the secondary anode donates plating current which passes laterally through the membrane 225 and then vertically towards the wafer through the CIRP 219. Positioning the secondary anode, such that the current passes through the ionically resistive ionically permeable element was found to be associated with improved uniformity, particularly at the near-edge region of the wafer substrate. When the secondary anode is positioned such that the current is passed through the ionically resistive ionically permeable element, the ionically resistive ionically permeable element is constructed such that it contains at least three distinct regions, where the region that passes current from the primary anode is electrically isolated from the region that passes current from the secondary anode. The top view of such ionically resistive ionically permeable element, in accordance with some embodiments, is shown in FIG. 3A. The central portion 301 is typically substantially coextensive with the primary anode and is ionically permeable (e.g., contains non-communicating channels drilled through the plate); the "dead zone" portion 303 surrounds the central portion 301 and serves to prevent electrical and fluidic communication between the inner ionically permeable portion 301 and the outer ionically permeable portion 305. The "dead zone" portion, in some embodiments is ionically impermeable (i.e. it does not have any through-holes or the through-holes are blocked). In some embodiments the size of the "dead zone" W1 is between about 1-4 mm. The outer portion 305 of the ionically resistive ionically permeable element is ionically permeable. The outer portion is connected via a fluidic conduit to the secondary anode chamber on the side of the ionically resistive ionically permeable element that is opposite the side facing the wafer substrate. In this configuration, the currents from the primary anode and the secondary anode do not mix below the ionically resistive ionically permeable element and within the body of the element due to the presence of the "dead zone" portion that electrically separates the currents. Another feature of the apparatus illustrated in FIG. 2B, is a reduced diameter of the plating vessel and of the primary anode. For example, in some embodiments, the diameter of the plating vessel and of the primary anode is about 1-10% smaller than the diameter of the wafer substrate. In some embodiments the primary anode is substantially coextensive with the inner portion of the segmented CIRP 219.

The presence of the dead zone is associated with the need to prevent mixing of currents from the primary anode and the secondary anode. Where the inner and outer portions meet, the ionically resistive ionically permeable element must make a seal with the boundaries of the anode chamber and of the secondary anode chamber. This is illustrated by the dead zone 231 in FIG. 2B. While the prevention of electrical and fluidic communication between the inner and outer ionically permeable portions is desired at the lower portion of the ionically resistive ionically permeable element, in the gap between the elements' upper surface and directly below the wafer, there is, by necessity, ionic and fluidic communication within the catholyte. The dead zone arises from the need to separate communication and seal the CIRP 219 at its lower surface which is farthest from the substrate. The impact of having a large dead zone (for example, when the dead zone is approximately the same size or lager than the CIRP to wafer distance) is that the current distribution on the wafer will be somewhat more non-uniform than desired since there would be less current in the region of the wafer directly above the dead zone due to a discontinuous radial source of ion flux emanating from the CIRP. To correct this deficiency, in some embodiments, a "dead zone" region of missing holes is made to exist only on the lower surface of the ionically permeable ionically resistive element (i.e. on the surface that is closest to the anode).

Figure 4:
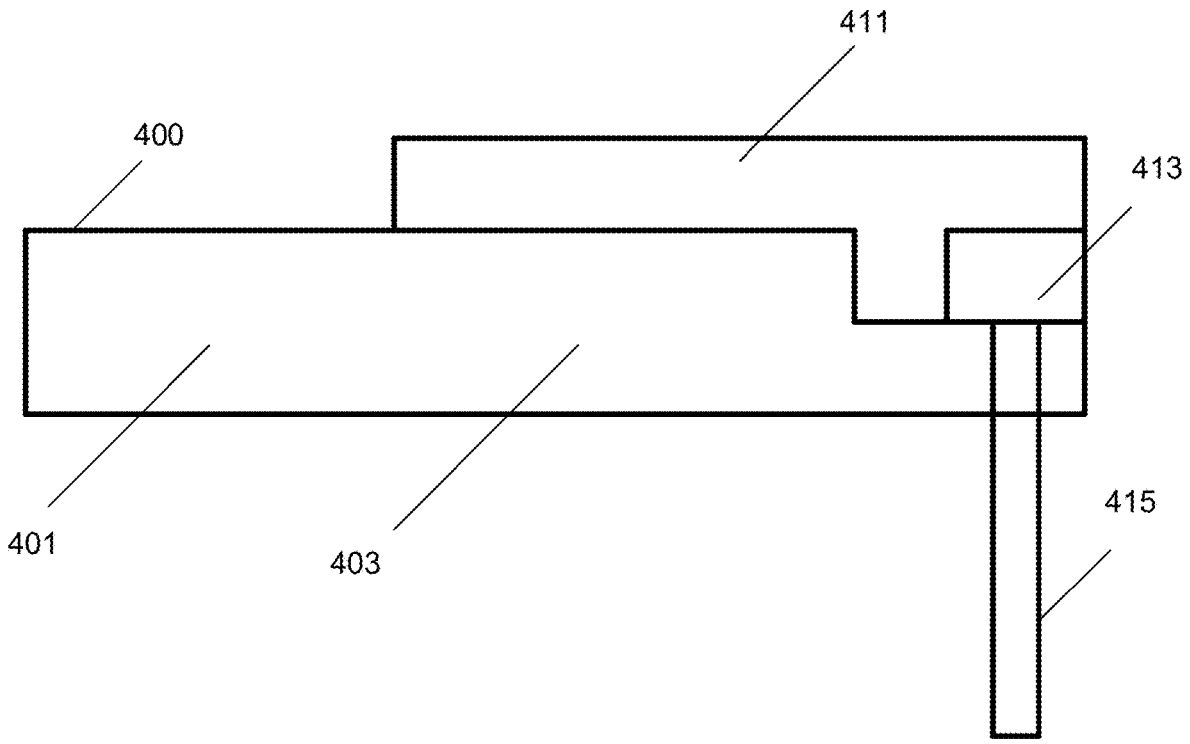
FIG. 4 is a schematic cross-sectional view of a portion of an assembly including the secondary anode, according to an embodiment provided herein.

A cross-sectional schematic view of a portion of an assembly including the active secondary anode is shown in FIG. 4. This configuration can be used in any of the apparatuses described herein. The active anode 400 includes a portion 401 that is exposed to the electrolyte during electroplating. Another portion that includes the charge coupling protrusion 403 is covered by a dielectric insert 411 that prevents the charge coupling protrusion from contacting the electrolyte and dissolving. The dielectric insert is shaped such that it fills the portion of the recess on the distal end of the charge coupling protrusion 403 and further covers the head 413 of a titanium fitting 415, which is inserted into the opening of the charge coupling protrusion. The bottom portion of the titanium fitting 415 is electrically connected to the power supply (not shown) that provides power to the secondary anode. In other embodiments the fitting (the metal coupling connecting the anode to the power supply) is made of other suitable metals, including, but not limited to stainless steel and copper.

Additional Features of Provided Apparatuses

In some embodiments it is preferable to equip the apparatus having a first or second configuration with a manifold that provides for a cross-flow of electrolyte near the surface of the wafer. Such manifold is particularly advantageous for electroplating in relatively large recessed features, such as WLP or TSV features. In these embodiments the apparatus may include a flow shaping element positioned between the CIRP and the wafer, where the flow-shaping element provides for a cross-flow substantially parallel to the surface of the wafer substrate. For example the flow shaping element may be an omega-shaped plate that directs the cross-flow is directed towards an opening in the plate. In some embodiments, the electrolyte enters the CIRP in a direction that is substantially perpendicular to the plating surface of the wafer, and after exiting the CIRP a cross-flow in a direction that is substantially parallel to the plating surface of the wafer is induced, because the flow of electrolyte is restricted by a wall. A lateral flow of electrolyte through the center of the substrate in a direction that is substantially parallel to the surface of the substrate is achieved. In some embodiments, the cross-flow is further (or primarily) induced by injecting catholyte in a direction that is substantially parallel to the surface of the substrate at a desired angular position (e.g., substantially across from the opening). In some embodiments an injection manifold injects the catholyte laterally into the narrow gap between the CIRP and the substrate.

In some embodiments, in the second configuration, the secondary anode chamber is positioned around the periphery of the plating vessel just above the membrane separating the catholyte and anolyte compartments of the plating vessel. In some embodiments, the part of the apparatus holding this membrane and defining the walls of the secondary anode chamber is one integral part.

In some embodiments, the secondary anode chamber 521 are irrigated through one or more dedicated irrigation channels configured to deliver suitable electrolyte to the respective chambers. The composition of the electrolyte may be the same or different as the composition of catholyte in the catholyte compartment of the electroplating chamber. In some embodiments the secondary anode chamber includes a system for removing bubbles.

In some embodiments, a tertiary, separately controllable electrode for additionally controlling azimuthal uniformity may be added. The tertiary electrode may be used in conjunction with both the first and second configurations of the apparatus. The tertiary electrode in the second configuration is preferably positioned such that the current diverted and/or donated by the tertiary electrode passes through the ionically resistive ionically permeable element but does not pass through the membrane separating anolyte and catholyte compartments. The suitable tertiary electrodes include azimuthally asymmetrical and segmented anodes, cathodes and electrodes that are capable of serving both as an anode and a cathode.

As it was mentioned above, both in the first and in the second configuration of the apparatus, the secondary anode may be separated from the substrate and catholyte compartment by an ion-permeable membrane. The ionically permeable membrane between the active anode and the catholyte chamber is useful for preventing particles from being transferred from the secondary anode chamber to the catholyte chamber. In other embodiments, instead of a membrane, a high outward-directed flow of electrolyte may be used to prevent the particles from reaching the surface of the substrate. The electrolyte is returned to the plating bath after it passes through a pump and then through a filter that is configured to remove the particles.

In one aspect, an electroplating method for plating metal on dissimilar substrates, such as on semiconductor wafers having different distribution of recessed features is provided. The process starts by providing a substrate into an apparatus having a secondary anode (e.g., an apparatus having a first or second configuration described herein). Next, metal is electroplated on the substrate while providing power to the secondary anode. During electroplating the substrate is negatively biased and is rotated. In some embodiments the power provided to the secondary anode is dynamically varied during electroplating. After electroplating is completed, a second dissimilar wafer is provided in the apparatus. Next, metal is plated on the second wafer while power is provided to the secondary anode. In some embodiments, the power provided to the secondary anode during electroplating on the second wafer is different than power provided to the first wafer and/or the power is dynamically modulated during electroplating differently than during plating on the first wafer substrate. In some embodiments, power is provided to the secondary anode only during electroplating of selected wafers. For example, during electroplating of a first wafer it may not be necessary to apply power to the secondary anode, while during electroplating on the second wafer, power to the secondary anode may be applied.

Dynamic control of power provided to the secondary anode can have a variety of forms. For example, power provided to the secondary anode may be gradually reduced or increased during electroplating. In other embodiments, power to the secondary anode may be turned off or turned on after a pre-determined time, e.g., corresponding to a predetermined thickness of electroplating. Finally, both the primary and secondary anode currents can change in a fixed ratio and in concert.

Integrated Tools and Controller

Figure 5:
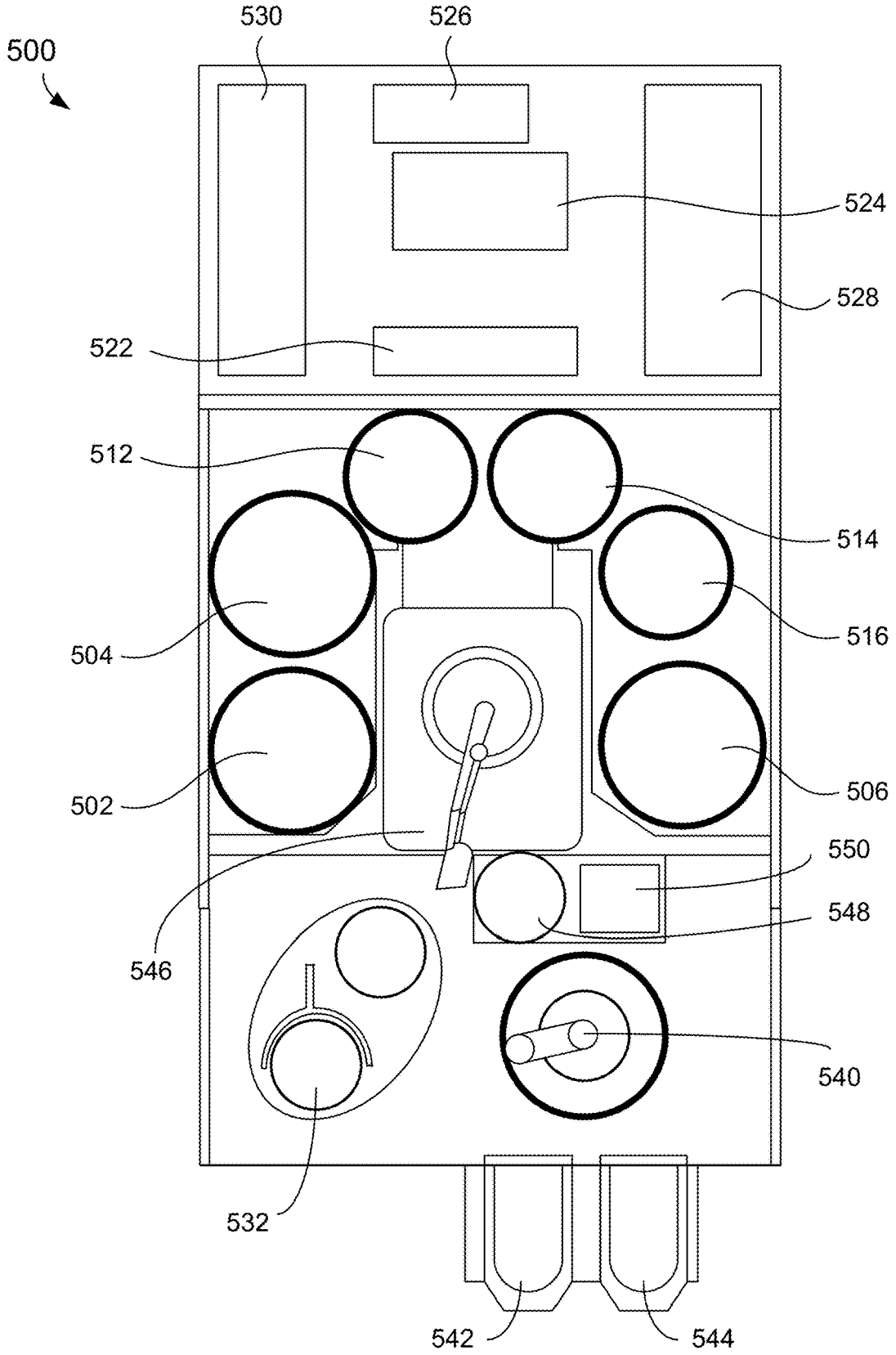
FIG. 5 is a schematic top view of a tool that includes an electroplating apparatus in accordance with an embodiment provided herein.

The electrodeposition methods disclosed herein can be described in reference to, and may be employed in the context of, various electroplating tool apparatuses. One example of a plating apparatus that may be used according to the embodiments herein is the Lam Research Sabre tool. Electrodeposition, including substrate immersion, and other methods disclosed herein can be performed in components that form a larger electrodeposition apparatus. FIG. 5 shows a schematic of a top view of an example electrodeposition apparatus. The electrodeposition apparatus 500 can include three separate electroplating modules 502, 504, and 506. The electrodeposition apparatus 500 can also include three separate modules 512, 514, and 516 configured for various process operations. For example, in some embodiments, one or more of modules 512, 514, and 516 may be a spin rinse drying (SRD) module. In other embodiments, one or more of the modules 512, 514, and 516 may be post-electrofill modules (PEMs), each configured to perform a function, such as edge bevel removal, backside etching, and acid cleaning of substrates after they have been processed by one of the electroplating modules 502, 504, and 506.

The electrodeposition apparatus 500 includes a central electrodeposition chamber 524. The central electrodeposition chamber 524 is a chamber that holds the chemical solution used as the electroplating solution in the electroplating modules 502, 504, and 506. The electrodeposition apparatus 500 also includes a dosing system 526 that may store and deliver additives for the electroplating solution. A chemical dilution module 522 may store and mix chemicals to be used as an etchant. A filtration and pumping unit 528 may filter the electroplating solution for the central electrodeposition chamber 524 and pump it to the electroplating modules.

A system controller 530 provides electronic and interface controls required to operate the electrodeposition apparatus 500. The system controller 530 (which may include one or more physical or logical controllers) controls some or all of the properties of the electroplating apparatus 500. The system controller 530 typically includes one or more memory devices and one or more processors. The processor may include a central processing unit (CPU) or computer, analog and/or digital input/output connections, stepper motor controller boards, and other like components. Instructions for implementing appropriate control operations as described herein may be executed on the processor. These instructions may be stored on the memory devices associated with the system controller 530 or they may be provided over a network. In certain embodiments, the system controller 530 executes system control software.

The system control software in the electrodeposition apparatus 500 may include instructions for controlling the timing, mixture of electrolyte components (including the concentration of one or more electrolyte components), inlet pressure, plating cell pressure, plating cell temperature, substrate temperature, current and potential applied to the substrate and any other electrodes, substrate position, substrate rotation, and other parameters of a particular process performed by the electrodeposition apparatus 500. The system control logic may also include instructions for electroplating using the secondary anode described herein. For example, the system control logic may be configured to provide specific power levels to the primary and secondary anodes. System control logic may be configured in any suitable way. For example, various process tool component sub-routines or control objects may be written to control operation of the process tool components necessary to carry out various process tool processes. System control software may be coded in any suitable computer readable programming language. The logic may also be implemented as hardware in a programmable logic device (e.g., an FPGA), an ASIC, or other appropriate vehicle.

In some embodiments, system control logic includes input/output control (IOC) sequencing instructions for controlling the various parameters described above. For example, each phase of an electroplating process may include one or more instructions for execution by the system controller 530. The instructions for setting process conditions for an immersion process phase may be included in a corresponding immersion recipe phase. In some embodiments, the electroplating recipe phases may be sequentially arranged, so that all instructions for an electroplating process phase are executed concurrently with that process phase.

The control logic may be divided into various components such as programs or sections of programs in some embodiments. Examples of logic components for this purpose include a substrate positioning component, an electrolyte composition control component, a pressure control component, a heater control component, and a potential/current power supply control component.

In some embodiments, there may be a user interface associated with the system controller 530. The user interface may include a display screen, graphical software displays of the apparatus and/or process conditions, and user input devices such as pointing devices, keyboards, touch screens, microphones, etc.

In some embodiments, parameters adjusted by the system controller 530 may relate to process conditions. Non-limiting examples include bath conditions (temperature, composition, and flow rate), substrate position (rotation rate, linear (vertical) speed, angle from horizontal) at various stages, etc. These parameters may be provided to the user in the form of a recipe, which may be entered utilizing the user interface.

Signals for monitoring the process may be provided by analog and/or digital input connections of the system controller 530 from various process tool sensors. The signals for controlling the process may be output on the analog and digital output connections of the process tool. Non-limiting examples of process tool sensors that may be monitored include mass flow controllers, pressure sensors (such as manometers), thermocouples, optical position sensors, etc. Appropriately programmed feedback and control algorithms may be used with data from these sensors to maintain process conditions.

A hand-off tool 540 may select a substrate from a substrate cassette such as the cassette 542 or the cassette 544. The cassettes 542 or 544 may be front opening unified pods (FOUPs). A FOUP is an enclosure designed to hold substrates securely and safely in a controlled environment and to allow the substrates to be removed for processing or measurement by tools equipped with appropriate load ports and robotic handling systems. The hand-off tool 540 may hold the substrate using a vacuum attachment or some other attaching mechanism.

The hand-off tool 540 may interface with a wafer handling station 532, the cassettes 542 or 544, a transfer station 550, or an aligner 548. From the transfer station 550, a hand-off tool 546 may gain access to the substrate. The transfer station 550 may be a slot or a position from and to which hand-off tools 540 and 546 may pass substrates without going through the aligner 548. In some embodiments, however, to ensure that a substrate is properly aligned on the hand-off tool 546 for precision delivery to an electroplating module, the hand-off tool 546 may align the substrate with an aligner 548. The hand-off tool 546 may also deliver a substrate to one of the electroplating modules 502, 504, or 506 or to one of the three separate modules 512, 514, and 516 configured for various process operations.

An example of a process operation according to the methods described above may proceed as follows: (1) electrodeposit copper onto a substrate to form a copper containing structure in the electroplating module 504; (2) rinse and dry the substrate in SRD in module 512; and, (3) perform edge bevel removal in module 514.

An apparatus configured to allow efficient cycling of substrates through sequential plating, rinsing, drying, and PEM process operations may be useful for implementations for use in a manufacturing environment. To accomplish this, the module 512 can be configured as a spin rinse dryer and an edge bevel removal chamber. With such a module 512, the substrate would only need to be transported between the electroplating module 504 and the module 512 for the copper plating and EBR operations.

In some implementations, a controller (e.g., system controller 530) is part of a system, which may be part of the above-described examples. Such systems can comprise semiconductor processing equipment, including a processing tool or tools, chamber or chambers, a platform or platforms for processing, and/or specific processing components (a wafer pedestal, a gas flow system, etc.). These systems may be integrated with electronics for controlling their operation before, during, and after processing of a semiconductor wafer or substrate. The electronics may be referred to as the "controller," which may control various components or subparts of the system or systems. The controller, depending on the processing requirements and/or the type of system, may be programmed to control any of the processes disclosed herein, including the delivery of processing gases, temperature settings (e.g., heating and/or cooling), pressure settings, vacuum settings, power settings, radio frequency (RF) generator settings, RF matching circuit settings, frequency settings, flow rate settings, fluid delivery settings, positional and operation settings, wafer transfers into and out of a tool and other transfer tools and/or load locks connected to or interfaced with a specific system.

Broadly speaking, the controller may be defined as electronics having various integrated circuits, logic, memory, and/or software that receive instructions, issue instructions, control operation, enable cleaning operations, enable endpoint measurements, and the like. The integrated circuits may include chips in the form of firmware that store program instructions, digital signal processors (DSPs), chips defined as application specific integrated circuits (ASICs), and/or one or more microprocessors, or microcontrollers that execute program instructions (e.g., software). Program instructions may be instructions communicated to the controller in the form of various individual settings (or program files), defining operational parameters for carrying out a particular process on or for a semiconductor wafer or to a system. The operational parameters may, in some embodiments, be part of a recipe defined by process engineers to accomplish one or more processing steps during the fabrication of one or more layers, materials, metals, oxides, silicon, silicon dioxide, surfaces, circuits, and/or dies of a wafer.

The controller, in some implementations, may be a part of or coupled to a computer that is integrated with, coupled to the system, otherwise networked to the system, or a combination thereof. For example, the controller may be in the "cloud" or all or a part of a fab host computer system, which can allow for remote access of the wafer processing. The computer may enable remote access to the system to monitor current progress of fabrication operations, examine a history of past fabrication operations, examine trends or performance metrics from a plurality of fabrication operations, to change parameters of current processing, to set processing steps to follow a current processing, or to start a new process. In some examples, a remote computer (e.g. a server) can provide process recipes to a system over a network, which may include a local network or the Internet. The remote computer may include a user interface that enables entry or programming of parameters and/or settings, which are then communicated to the system from the remote computer. In some examples, the controller receives instructions in the form of data, which specify parameters for each of the processing steps to be performed during one or more operations. It should be understood that the parameters may be specific to the type of process to be performed and the type of tool that the controller is configured to interface with or control. Thus as described above, the controller may be distributed, such as by comprising one or more discrete controllers that are networked together and working towards a common purpose, such as the processes and controls described herein. An example of a distributed controller for such purposes would be one or more integrated circuits on a chamber in communication with one or more integrated circuits located remotely (such as at the platform level or as part of a remote computer) that combine to control a process on the chamber.

Without limitation, example systems may include a plasma etch chamber or module, a deposition chamber or module, a spin-rinse chamber or module, a metal plating chamber or module, a clean chamber or module, a bevel edge etch chamber or module, a physical vapor deposition (PVD) chamber or module, a chemical vapor deposition (CVD) chamber or module, an atomic layer deposition (ALD) chamber or module, an atomic layer etch (ALE) chamber or module, an ion implantation chamber or module, a track chamber or module, and any other semiconductor processing systems that may be associated or used in the fabrication and/or manufacturing of semiconductor wafers.

As noted above, depending on the process step or steps to be performed by the tool, the controller might communicate with one or more of other tool circuits or modules, other tool components, cluster tools, other tool interfaces, adjacent tools, neighboring tools, tools located throughout a factory, a main computer, another controller, or tools used in material transport that bring containers of wafers to and from tool locations and/or load ports in a semiconductor manufacturing factory.

Figure 6:
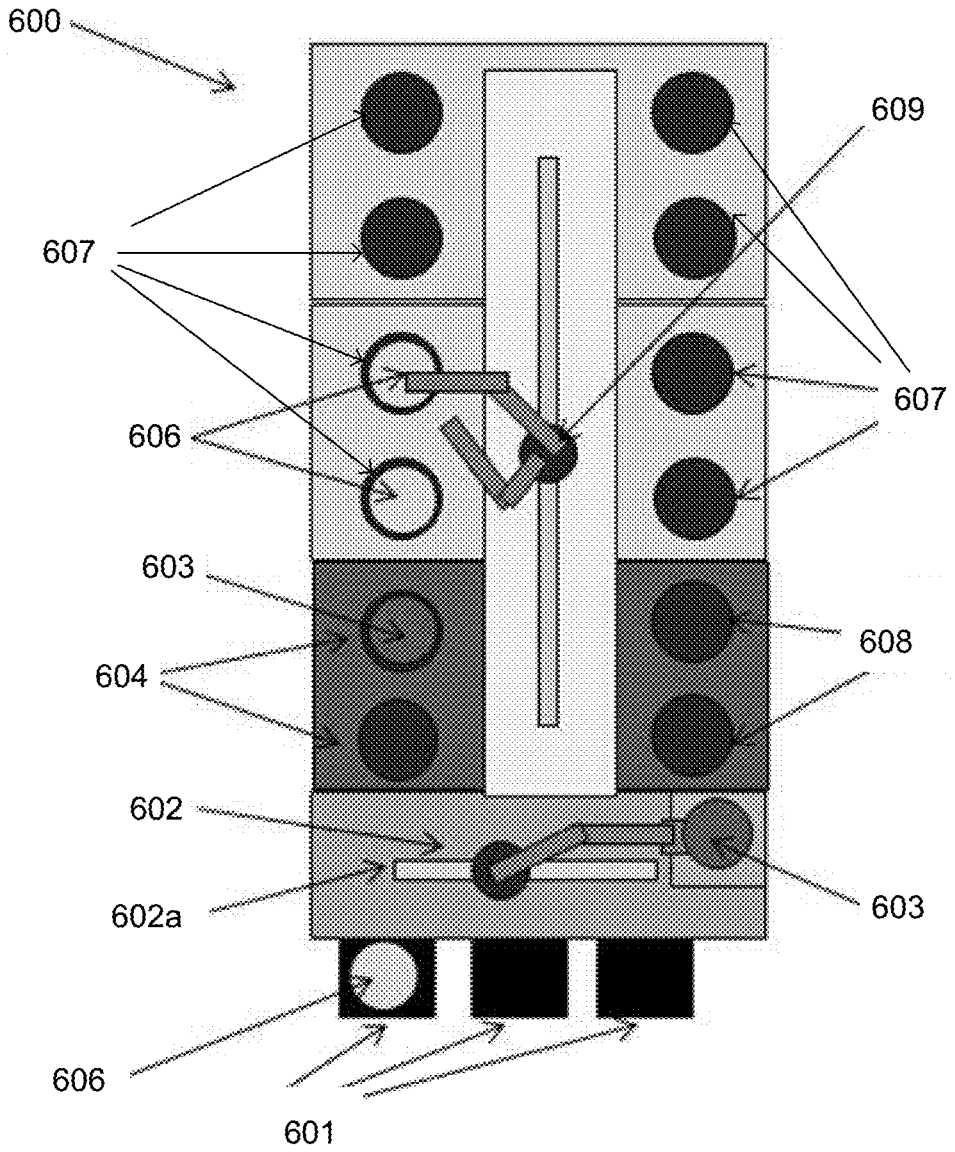
FIG. 6 is a schematic top view of a tool that includes an electroplating apparatus in accordance with another embodiment provided herein.

An alternative embodiment of an electrodeposition apparatus 600 is schematically illustrated in FIG. 6. In this embodiment, the electrodeposition apparatus 600 has a set of electroplating cells 607, each containing an electroplating bath, in a paired or multiple "duet" configuration. In addition to electroplating per se, the electrodeposition apparatus 600 may perform a variety of other electroplating related processes and sub-steps, such as spin-rinsing, spin-drying, metal and silicon wet etching, electroless deposition, pre-wetting and pre-chemical treating, reducing, annealing, photoresist stripping, and surface pre-activation, for example. The electrodeposition apparatus 600 is shown schematically looking top down in FIG. 6, and only a single level or "floor" is revealed in the figure, but it is to be readily understood by one having ordinary skill in the art that such an apparatus, e.g. the Lam Research Sabre™ 3 D tool, can have two or more levels "stacked" on top of each other, each potentially having identical or different types of processing stations.

Referring once again to FIG. 6, the substrates 606 that are to be electroplated are generally fed to the electrodeposition apparatus 600 through a front end loading FOUP 601 and, in this example, are brought from the FOUP to the main substrate processing area of the electrodeposition apparatus 600 via a front-end robot 602 that can retract and move a substrate 606 driven by a spindle 603 in multiple dimensions from one station to another of the accessible stations—two front-end accessible stations 604 and also two front-end accessible stations 608 are shown in this example. The front-end accessible stations 604 and 608 may include, for example, pre-treatment stations, and spin rinse drying (SRD) stations. Lateral movement from side-to-side of the front-end robot 602 is accomplished utilizing robot track 602*a*. Each of the substrates 606 may be held by a cup/cone assembly (not shown) driven by a spindle 603 connected to a motor (not shown), and the motor may be attached to a mounting bracket 609. Also shown in this example are the four "duets" of electroplating cells 607, for a total of eight electroplating cells 607. The electroplating cells 607 may be used for electroplating copper for the copper containing structure and electroplating solder material for the solder structure. A system controller (not shown) may be coupled to the electrodeposition apparatus 600 to control some or all of the properties of the electrodeposition apparatus 600. The system controller may be programmed or otherwise configured to execute instructions according to processes described earlier herein.

The apparatus/process described herein may be used in conjunction with lithographic patterning tools or processes, for example, for the fabrication or manufacture of semiconductor devices, displays, LEDs, photovoltaic panels and the like. Typically, though not necessarily, such tools/processes will be used or conducted together in a common fabrication facility. Lithographic patterning of a film typically includes some or all of the following operations, each operation enabled with a number of possible tools: (1) application of photoresist on a workpiece, i.e., wafer, using a spin-on or spray-on tool; (2) curing of photoresist using a hot plate or furnace or UV curing tool; (3) exposing the photoresist to visible or UV or x-ray light with a tool such as a wafer stepper; (4) developing the resist so as to selectively remove resist and thereby pattern it using a tool such as a wet bench; (5) transferring the resist pattern into an underlying film or workpiece by using a dry or plasma-assisted etching tool; and (6) removing the resist using a tool such as an RF or microwave plasma resist stripper.

The invention claimed is:

1. An active anode comprising:

a generally annular body having an inner surface and an outer surface; and a protrusion extending outward from the outer surface, wherein the active anode is a single-piece copper anode, wherein copper in the active anode has an average grain size of between about 150 μm and about 450 μm, and wherein compositions of the generally annular body and of the protrusion are the same.

2. The active anode of claim 1, wherein the single-piece copper anode comprises copper (Cu) and phosphorus (P).

3. The active anode of claim 2, wherein the single-piece copper anode comprises at least about 99.9% copper and between about 400 and about 650 ppm phosphorus by weight.

4. The active anode of claim 1, wherein the protrusion comprises an opening at a distal terminus of the protrusion, and wherein the distal terminus of the protrusion surrounding the opening is recessed.

5. The active anode of claim 1, wherein the generally annular body of the active anode has an inner diameter of at least about 317.5 mm and an outer diameter of no larger than about 355.6 mm.

6. The active anode of claim 1, wherein the generally annular body of the active anode has an inner diameter of about 330 mm and an outer diameter of about 352 mm.

7. The active anode of claim 1, wherein the protrusion has a maximum width of between about 8 mm and about 10 mm.

8. The active anode of claim 1, wherein the protrusion has a maximum width of about 9 mm.

9. The active anode of claim 1, wherein the annular body and the protrusion have maximum thickness of about 10 mm.

10. The active anode of claim 1, wherein a length of the protrusion is between about 33 mm and about 37 mm.

11. An active anode comprising:

a generally annular body having an inner surface and an outer surface; and a protrusion extending outward from the outer surface, wherein the active anode is a copper anode, a cobalt anode, or a nickel anode, wherein compositions of the generally annular body and of the protrusion are the same, wherein the generally annular body has an inner diameter of at least about 318 mm and an outer diameter of no larger than about 355 mm; wherein the protrusion has an opening at a distal terminus of the protrusion, wherein a distance between a center of an annulus defining the generally annular body and a center of the opening at the distal terminus of the protrusion is between about 197 mm and about 217 mm.

12. An electroplating apparatus for electroplating a metal on a substrate, the apparatus comprising:

(a) a plating chamber configured to contain an electrolyte, the plating chamber comprising a catholyte compartment and an anolyte compartment, wherein the anolyte compartment and the catholyte compartment are separated by an ion-permeable membrane;

(b) a substrate holder configured to hold and rotate the substrate in the catholyte compartment during electroplating;

(c) a primary anode positioned in the anolyte compartment of the plating chamber;

(d) an ionically resistive ionically permeable element positioned between the ion-permeable membrane and the substrate holder, wherein the ionically resistive ionically permeable element is adapted to provide ionic transport through the element during electroplating; and (e) a secondary anode configured to donate plating current to the substrate, wherein the secondary anode is positioned such that the donated current does not cross the ion-permeable membrane separating the anolyte and catholyte compartments, and wherein the secondary anode is positioned such as to donate plating current through the ionically resistive ionically permeable element, wherein the secondary anode comprises a generally annular body having an inner surface and an outer surface; and at least one protrusion extending outward from the outer surface, wherein the active anode is a copper anode, cobalt anode, or a nickel anode, and wherein compositions of the generally annular body and of the at least one protrusion of the secondary anode are the same.

13. The apparatus of claim 12, wherein the secondary anode is a single-piece copper anode.

14. The apparatus of claim 12, wherein the secondary anode is a single-piece cobalt anode.

15. The apparatus of claim 12, wherein the secondary anode is positioned in a secondary anode compartment around the periphery of the plating chamber.

16. The apparatus of claim 12, wherein the at least one protrusion of the anode is electrically connected to a power supply via a metal coupling and a power supply cable.

17. The active anode of claim 1, wherein the protrusion comprises an opening at a distal terminus of the protrusion.

* * * * *